US009588538B2

(12) United States Patent
Blanc et al.

(10) Patent No.: US 9,588,538 B2
(45) Date of Patent: Mar. 7, 2017

(54) REFERENCE VOLTAGE GENERATION CIRCUIT

(71) Applicants: STMicroelectronics SA, Montrouge (FR); STMicroelectronics International N.V., Amsterdam (NL)

(72) Inventors: Jean-Pierre Blanc, Theys (FR); Pratap Narayan Singh, Chahania Chandauli (IN)

(73) Assignees: STMICROELECTRONICS SA, Montrouge (FR); STMICROELECTRONICS INTERNATIONAL N.V., Amsterdam (NL)

( * ) Notice: Subject to any disclaimer, the term of this patent is extended or adjusted under 35 U.S.C. 154(b) by 0 days.

(21) Appl. No.: 14/675,309

(22) Filed: Mar. 31, 2015

(65) Prior Publication Data

US 2015/0286238 A1 Oct. 8, 2015

(30) Foreign Application Priority Data

Apr. 4, 2014 (FR) ..... 14 53014

(51) Int. Cl.

| | |
|---|---|
| ***H05F 3/02*** | (2006.01) |
| ***G05F 3/16*** | (2006.01) |
| ***G05F 3/26*** | (2006.01) |
| ***G05F 3/30*** | (2006.01) |

(52) U.S. Cl.

CPC ..... *G05F 3/16* (2013.01); *G05F 3/26* (2013.01); *G05F 3/267* (2013.01); *G05F 3/30* (2013.01)

(58) Field of Classification Search

CPC ..... G05F 3/16; G05F 3/30; G05F 3/26; G05F 3/267

See application file for complete search history.

(56) References Cited

U.S. PATENT DOCUMENTS

| | | | | |
|---|---|---|---|---|
| 4,157,493 | A * | 6/1979 | Monticelli | G05F 3/30 323/314 |
| 4,590,419 | A | 5/1986 | Moriarty, Jr. | |
| 5,349,286 | A * | 9/1994 | Marshall | G05F 3/30 323/313 |
| 6,002,243 | A * | 12/1999 | Marshall | G05F 3/262 323/313 |
| 6,160,391 | A | 12/2000 | Banba | |
| 7,408,400 | B1 | 8/2008 | DeStasi | |
| 7,710,096 | B2 * | 5/2010 | Kotchkine | G05F 3/30 323/313 |
| 7,852,142 | B2 | 12/2010 | Ogiwara et al. | |
| 2009/0146730 | A1 | 6/2009 | Chen | |
| 2011/0169561 | A1 | 7/2011 | Chu et al. | |
| 2012/0153997 | A1 | 6/2012 | Blanc et al. | |

* cited by examiner

*Primary Examiner* — Jung Kim
(74) *Attorney, Agent, or Firm* — Seed IP Law Group LLP

(57) ABSTRACT

A reference voltage generation circuit, including a first current source in series with a first bipolar transistor; a second current source in series with a first resistor; a third current source in series with a second bipolar transistor, the third current source being assembled as a current mirror with the first current source; a second resistor between the base of the second bipolar transistor and the junction point between the current source and the first resistor; and a fourth current source in series with a third resistor, the junction point between the fourth current source and the third resistor defining a reference voltage terminal.

18 Claims, 4 Drawing Sheets

REFERENCE VOLTAGE GENERATION CIRCUIT

BACKGROUND

Technical Field

The present disclosure relates to a circuit for gene-rating a reference voltage under a power supply voltage smaller than 1 V.

Description of the Related Art

FIG. 1 hereof corresponds to FIG. 3 of French patent application 2969328 of Dec. 17, 2010 (B10442). This drawing shows an example of a circuit generating a reference voltage in the order of 0.1 V. This circuit comprises, between two terminals of application of a power supply voltage $V_{DD}$ and ground GND:

- a MOS transistor M1 in series with a bipolar transistor Q1, of type NPN, having its emitter on the side of ground GND;
- a MOS transistor M2 in series with a bipolar transistor Q2 (of type NPN, having its emitter on the side of ground GND) and with a resistor R1, the emitter of transistor Q2 defining an output terminal of the circuit providing a reference voltage $V_{OUT}$, transistors M1 and M2 being assembled as a current mirror; and
- the power supply terminals of a follower assembly 3.

The input of the follower assembly is connected to the collector of transistor Q1 and its output is connected by an optional resistor R2 to the base of transistor Q2. A resistive dividing bridge formed of resistors R3 and R4 in series is connected between the output terminal of follower assembly 3 and ground GND. The midpoint of this dividing bridge is connected to the base of transistor Q1. Resistor R4 is connected between the base of transistor Q1 and ground GND.

Due to the current mirror formed of MOS transistors M1 and M2, transistors Q1 and Q2 receive the same collector current.

As indicated by the above-mentioned French patent application, reference voltage $V_{OUT}$ can be written as follows, neglecting base current $i_{b2}$ of transistor Q2:

$$V_{OUT}=V_{BE1}*(R4/R3)+(kT/q)*In(p_{2|1}), \quad (1)$$

where $V_{BE1}$ designates the base-emitter voltage of transistor Q1, k designates Boltzmann's constant, q designate the electron charge, T designates the temperature in Kelvin, and $In(p_{2|1})$ designates the natural logarithm of surface ratio $p_{2|1}$ between transistors Q1 and Q2 ($p_{2|1}$ being greater than 1).

Follower assembly 3 is formed of a current source 4 and of a MOS transistor M3. The gate of transistor M3 corresponds to the input of follower assembly 3 and the source of MOS transistor M3 corresponds to the output of follower assembly 3. The follower assembly has the voltage present on its input follow on its output and delivers the current necessary to drive the bases of transistors Q1 and Q2 and for resistor R4. This circuit has an infinite input impedance, and no current flows through the gate of MOS transistor M3.

The base currents of transistors Q1 and Q2 are equal (due to transistors Ml and M2 assembled as a current mirror). Resistor R2 is added to cancel the effect of the base currents on the reference voltage. The compensation will be optimal if the values of resistances R2 and R3 are equal.

Resistor R1 sets the current in the two branches of the assembly. Power supply voltage $V_{DD}$ can be written as:

$$V_{DD}=V_{OUT}+V_{BE2}+R2*i_{b2}+V_4, \quad (2)$$

where $V_{OUT}$ is the reference voltage generated by circuit, $V_{BE2}$ is the base-emitter voltage of transistor Q2, and $V_4$ is the voltage drop across current source 4.

In practice, in current integrated circuit technologies, the base-emitter voltage of a bipolar transistor is in the order of 0.8 V and the drain-source voltage of a MOS transistor at saturation is in the order of 0.1 V. If a reference voltage $V_{OUT}$ of 0.1 V is desired to be generated, formula (2) thus provides $V_{DD}$=0.1+0.8+0.1=1 V, neglecting term R2*$i_{b2}$, which is much smaller than 0.1 V.

FIG. 2 hereof corresponds to FIG. 2 of U.S. Pat. No. 7,408,400. This drawing shows an example of a circuit generating a reference voltage in the order of 0.1 V. This circuit comprises, between two terminals of application of a power supply voltage $V_{DD}$ and ground GND:

- a current source 11 generating a current $I_1$ in series with a bipolar transistor Q3, of type NPN;
- a current source 13 generating a current $I_2$ in series with a bipolar transistor Q4, of type NPN;
- a current source 15 generating the same current $I_1$ as current source 11 in series with a bipolar transistor Q5, of type NPN, and with a resistor R7, the base of transistor Q5 being connected to the collector of transistor Q4; and
- a bipolar transistor Q6, of type NPN, in series with a current source 17, the base of transistor Q6 being connected to the collector of transistor Q5 and the emitter of transistor Q6 being connected to the base of transistor Q4.

Resistor R5 is connected between the base of transistor Q3 and ground GND. A resistor R6 is connected between the collector of transistor Q4 and the base of transistor Q3. A bipolar transistor Q7 is connected between terminal $V_{DD}$ and the emitter of transistor Q5. The base of transistor Q7 is connected to the collector of transistor Q3. The junction point of the emitters of transistors Q5 and Q7 forms output $V_{OUT}$ of the circuit.

Transistors Q3 and Q5 receive a same collector current $I_t$. As indicated by the above-mentioned US patent, reference voltage $V_{OUT}$ can be written as follows:

$$V_{OUT}=V_{BE3}*(R6/R5)+(kT/q)*In(p_{5|3}), \quad (3)$$

where $V_{BE3}$ designates the base-emitter voltage of transistor Q3, k, q, and T have been previously defined, and $p_{5|3}$ designates the surface ratio between transistors Q3 and Q5 ($p_{5|3}$ being greater than 1).

Power supply voltage $V_{DD}$ can be written as:

$$V_{DD}=V_{OUT}+V_{BE7}+V_{11}, \quad (4)$$

where $V_{OUT}$ is the reference voltage generated by circuit, $V_{BE7}$ is the base-emitter voltage of transistor Q7, and $V_{11}$ is the voltage drop across current source 11.

In practice, in current integrated circuit technologies, the base-emitter voltage of a bipolar transistor is in the order of 0.8 V and the drain-source voltage of a MOS transistor at saturation is in the order of 0.1 V. If a reference voltage $V_{OUT}$ of 0.1 V is desired to be generated, formula (4) thus provides $V_{DD}$=0.1+0.8+0.1=1 V.

The power supply voltages of the circuits of FIGS. 1 and 2 are greater than or equal to 1 V.

Further, in the circuits of FIGS. 1 and 2, if voltage $V_{OUT}$ is desired to be increased by 1 V, the power supply voltage should increase by 1 V.

Recent circuits in CMOS technology operate under power supply voltages smaller than or equal to 1 V. The circuits of FIGS. 1 and 2 can thus not be used since they require a power supply voltage greater than 1 V.

BRIEF SUMMARY

It would be desirable to provide a reference voltage generation circuit having a power supply voltage smaller than 1 V.

It would also be desirable to provide such a circuit capable of generating a reference voltage greater than 0.1 V.

Thus, an embodiment provides a circuit for generating a reference voltage, comprising, between first and second terminals of application of a power supply voltage: a first current source in series with a first bipolar transistor; a second current source in series with a first resistive element, the junction point between the second current source and the first resistive element being connected to the base of the first bipolar transistor; a third current source in series with a second bipolar transistor, the third current source being assembled as a current mirror with the first current source; a second resistive element between the base of the second bipolar transistor and the junction point of the current source and of the first resistive element; and a fourth current source in series with a third resistive element, the junction point of the fourth current source and of the third resistive element defining a third terminal providing the reference voltage, the fourth current source forming a current mirror with the second current source.

According to an embodiment, a fifth current source is connected between the first terminal and the third terminal, and a fourth resistive element is series-connected with the second bipolar transistor, the fifth current source forming a current mirror with the first current source.

According to an embodiment, the current sources are formed of MOS transistors.

According to an embodiment, the surface area of the collector of the second bipolar transistor is larger than the surface area of the collector of the first bipolar transistor.

The foregoing and other features and advantages will be discussed in detail in the following non-limiting description of specific embodiments in connection with the accompanying drawings.

DETAILED DESCRIPTION

The present description corresponds to the case of transistors in CMOS technology. It may however be applied to any other transistor technology or to a combination of different technologies. In the following, "PMOS transistor" will designate P-channel MOS transistors.

Figure 3:
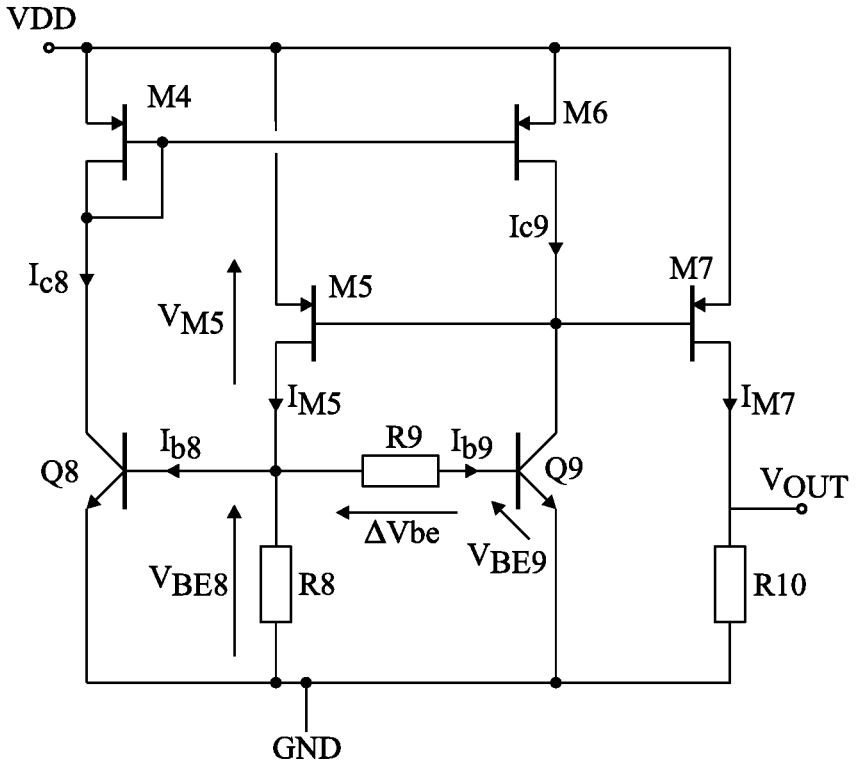
FIGS. 3 and 4 illustrate two embodiments of a circuit for generating a 0.1-V reference voltage.

FIG. 3 illustrates an embodiment of a reference voltage generation circuit. This circuit comprises, between two supply terminals respectively providing a power supply voltage $V_{DD}$ and of ground GND:

- a PMOS transistor M4 in series with a bipolar transistor Q8, of type NPN, having its emitter on the side of ground GND;
- a PMOS transistor M5 in series with a resistor R8, the base of transistor Q8 being connected to the drain of transistor M5;
- a PMOS transistor M6 in series with a bipolar transistor Q9, of type NPN, the emitter being on the side of ground GND and transistors M4 and M6 being assembled as a current mirror; and
- a PMOS transistor M7 in series with a resistor R10, the gate of transistor M7 being connected to the collector of transistor Q9 and to the gate of transistor M5, transistors M5 and M7 thus forming a current mirror, the drain of transistor M7 forming a reference voltage terminal $V_{OUT}$.

A resistor R9 is connected between the base of transistor Q9 and the drain of transistor M5.

The current mirror formed by transistors M4 and M6 results in that transistors Q8 and Q9 receive equal collector currents $I_{c8}$ and $I_{c9}$. The circuit is designed so that transistor M5 is in saturation state.

Power supply voltage $V_{DD}$ can be written as:

$$V_{DD}=V_{BE8}+V_{M5}, \tag{5}$$

where $V_{BE8}$ is the base-emitter voltage of transistor Q8, and $V_{M5}$ is the drain-source voltage of transistor M5.

In practice, in current integrated circuit technologies, the base-emitter voltage of a bipolar transistor is in the order of 0.8 V and the drain-source voltage of a MOS transistor at saturation is in the order of 0.1 V. Formula (5) thus provides $V_{DD}$=0.8+0.1=0.9 V.

Figure 1:
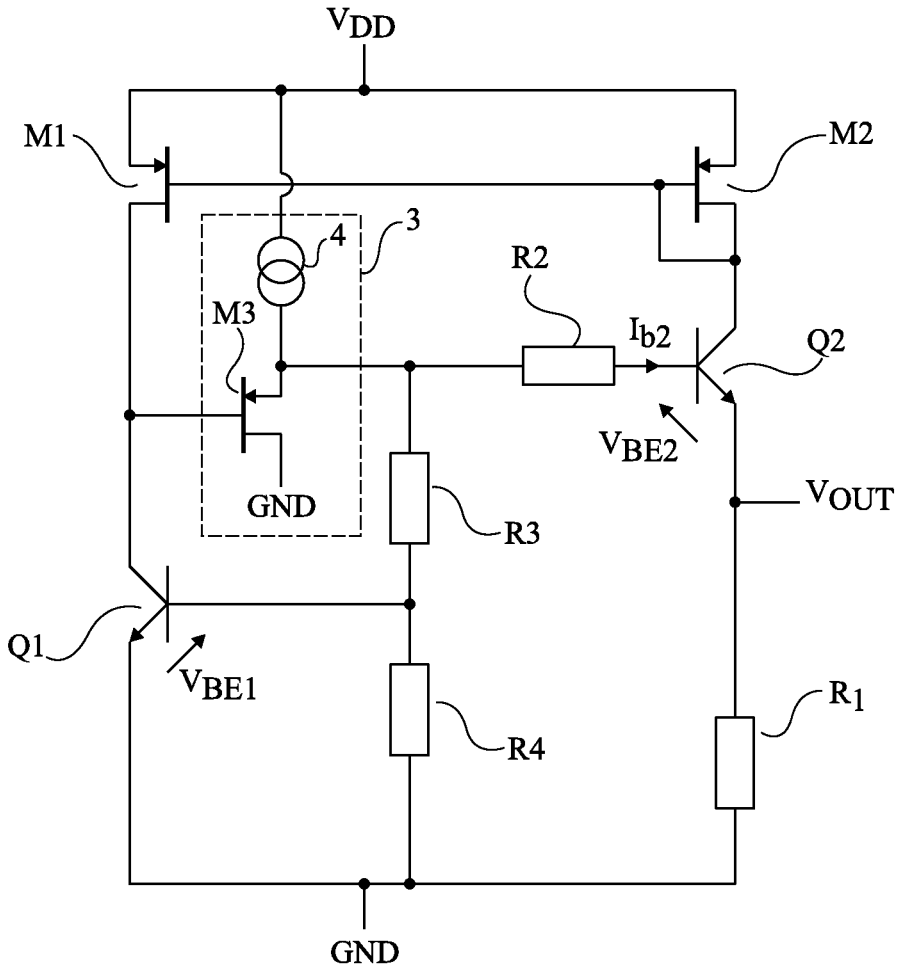
Fig 1 (Prior Art)
FIGS. 1 and 2, previously described, illustrate two examples of circuits for generating a 0.1-V reference voltage.
Figure 2:
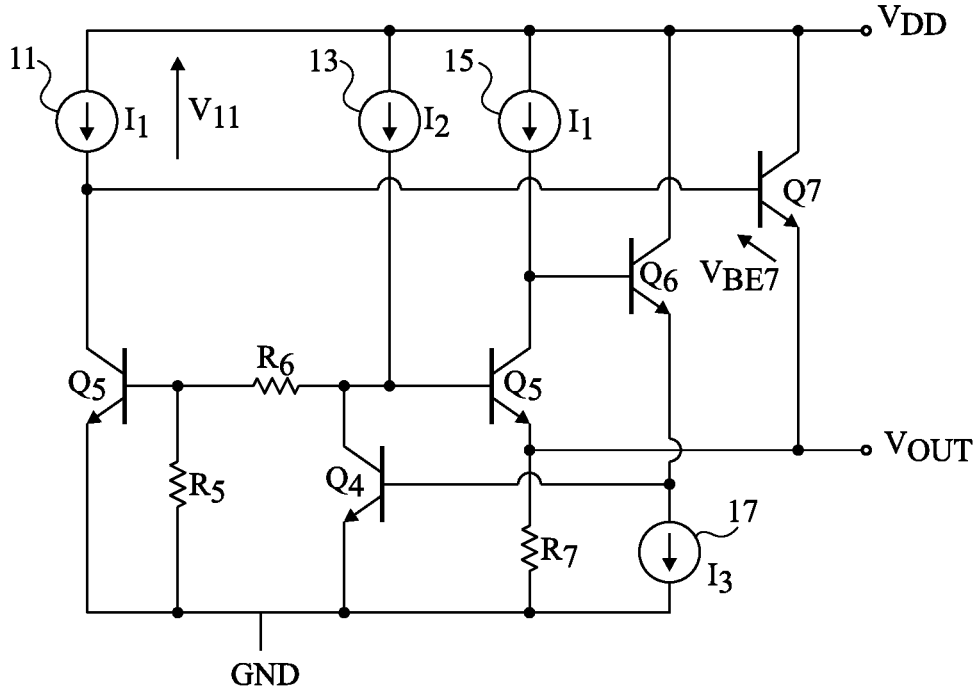
Fig 2 (Prior Art)

There appears from formula (5) that voltage $V_{DD}$ is smaller than 1 V and that it is independent from value $V_{OUT}$, conversely to the cases of circuits of FIGS. 1 and 2 and of formulas (2) and (4).

Further, transistor M7 operates in linear state when reference voltage $V_{OUT}$ is smaller than voltage $V_{BE8}$ (0.8 V). For a 0.9V power supply voltage, it is thus possible to set reference voltage $V_{OUT}$ in a range from 0.1 V to 0.8 V.

Reference voltage $V_{OUT}$ can be written as:

$$V_{OUT}=R10*I_{M7}, \tag{6}$$

where $I_{M7}$ is the current in resistor R10. Transistors M5 and M7 being assembled as a current mirror, current $I_{M7}$ is the copy of current $I_{M5}$.

Current $I_{M7}$ can be written as:

$$I_{M7}=I_{M5}=(V_{BE8}/R8)+i_{b8}+i_{b9}, \tag{7}$$

where $i_{b8}$ and $i_{b9}$ are the base currents of transistors Q8 and Q9. The collector currents of transistors Q8 and Q9 being equal, currents $i_{b8}$ and $i_{b9}$ are equal.

Current $i_{b9}$ can be written as:

$$i_{b9}=\Delta V_{BE}/R9,$$

where $\Delta V_{BE}=V_{BE8}-V_{BE9}=(kT/q)*\ln(p_{9|8})$, $V_{BE8}$ and $V_{BE9}$ designate the base-emitter voltages of transistor Q8 and Q9 and $\ln(p_{9|8})$ designates the natural logarithm of surface area ratio $p_{98}$ between transistors Q8 and Q9 ($p_{9|8}$ being greater than 1).

Reference voltage $V_{OUT}$ can be written as:

$$V_{OUT}=R10*[(V_{BE8}/R8)+(2*kT/q*R9)*ln(p_{9|8})], \tag{8}$$

An advantage of such a circuit is that power supply voltage $V_{DD}$ is 0.9 V only. This circuit may be used in recent circuits in CMOS technology operating under power supply voltages smaller than 1 V.

Another advantage is that for a power supply voltage of $V_{DD}$ of 0.9 V, the circuit can generate a reference voltage $V_{OUT}$ in the range from 0.1 V to 0.8 V.

However, as shown by formulas (6) and (7), reference voltage $V_{OUT}$ depends on base current $i_{b9}$ of transistor Q9. Current collector $i_{c9}$ of transistor Q9 is determined by relation $i_{c9}=\beta*i_{b9}$, β being the gain of transistor Q9. Gain β varies along with temperature and manufacturing dispersions. Currents $i_{c8}$ and $i_{c9}$ vary accordingly. Voltage $V_{BE8}$ varies according to current Ic8. According to formula (8), voltage $V_{OUT}$ depends on $V_{BE8}$. The variation of gain β of transistor Q9 thus degrades the accuracy of the generated reference voltage $V_{OUT}$. As an example, for a variation of gain β of transistor Q9 by a factor 2, voltage $V_{OUT}$ varies by approximately 2%.

A reference voltage $V_{OUT}$ independent from the variation of current gain β would be desired.

Figure 4:
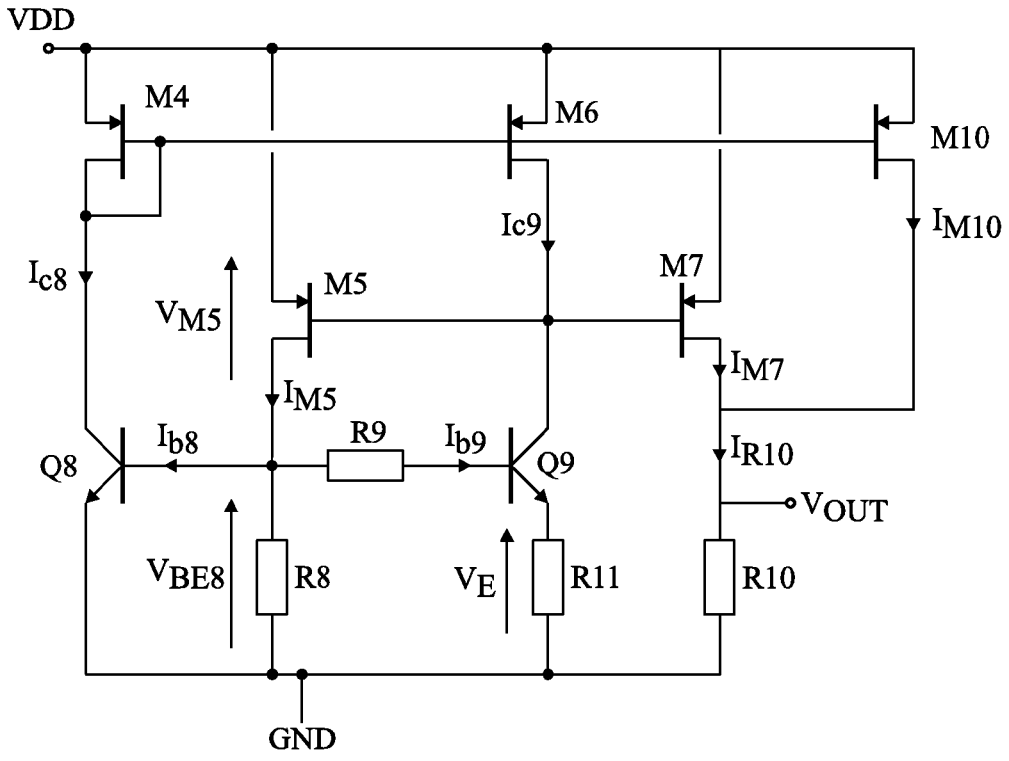

FIG. 4 illustrates another embodiment of a reference voltage generation circuit having the advantages of the embodiment of FIG. 3 while avoiding the possible variation of $V_{OUT}$ with gain β.

This circuit comprises the elements of the circuit of FIG. 3 designated with the same reference numerals. Further, a resistor R11 is placed between the emitter of transistor Q9 and ground GND and a PMOS transistor M10 is connected between power supply voltage $V_{DD}$ and the drain of transistor M7. The source of transistor M10 is connected to voltage $V_{DD}$. Transistor M10 forms a current mirror with transistors M4 and M6.

Power supply voltage $V_{DD}$ remains equal to:

$$V_{DD}=V_{BE8}+V_{M5}, \tag{5}$$

Reference voltage $V_{OUT}$ can be written as:

$$V_{OUT}=R10*I_{R10}=R10*(I_{M7}+I_{M10}) \tag{9}$$

where $I_{R10}$ is the current in resistor R10 and $I_{M10}$ is the drain current of transistor M10. Transistors M4, M6, and M10 being assembled as a current mirror, currents $i_{c8}$, $i_{c9}$, and $I_{M10}$ are equal. Transistors M5 and M7 being assembled as a current mirror, currents $I_{M5}$ and $I_{M7}$ are equal.

Current $i_{c9}$ can be written as:

$$i_{c9}=V_E/R11-i_{b9}, \tag{10}$$

where $V_E$ is the voltage across resistor R11.

Voltage $V_E$ can be written as:

$$V_E=\Delta V_{BE}-R9*i_{b9},$$

where $\Delta V_{BE}=V_{BE8}-V_{BE9}=(kT/q)*\ln(p_{9/8})$.

Current $i_{c9}$ can be written as:

$$i_{c9}=\Delta V_{BE}/R11-i_{b9}*(1+R9/R11).$$

Current $I_{R10}$ can thus be written as:

$$I_{R10}=V_{BE8}/R8+2*i_{b9}+\Delta V_{BE}/R11-i_{b9}*(1+R9/R11).$$

If resistors R9 and R11 are equal, current $I_{R10}$ no longer depends on current $i_{b9}$, $I_{R10}$ can be written as:

$$I_{R10}=V_{BE8}/R8+\Delta V_{BE}/R11$$

Reference voltage $V_{OUT}$ can thus be written as:

$$V_{OUT}=R10*[(V_{BE8}/R8)+(kT/q*R9)*In(p_{9/8})] \tag{11}$$

As shown by formula (11), current $i_{c9}$ no longer depends on gain β, conversely to the case of the circuit of FIG. 3. Voltage $V_{BE8}$ is no longer affected by the variation of gain β and, since voltage $V_{OUT}$ depends on $V_{BE8}$, the accuracy of voltage $V_{OUT}$ is no longer affected by gain β.

An advantage of such a circuit is that a possible variation of gain β of transistor Q9 does not affect the accuracy of reference voltage $V_{OUT}$.

Although term resistor has here been used to designate elements R1 to R11, it should be noted that these elements may be formed of any resistive element such as a resistor-connected MOS transistor.

The resistance values may be in the range from 1 to 100 kΩ, for example, 50 kΩ.

Such alterations, modifications, and improvements are intended to be part of this disclosure, and are intended to be within the spirit and the scope of the present disclosure. Accordingly, the foregoing description is by way of example only and is not intended to be limiting.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A circuit for generating a reference voltage, comprising:

first and second supply terminals configured to provide a power supply voltage;

a first MOS transistor and a first bipolar transistor electrically coupled in series between the first and second supply terminals;

a second MOS transistor and a first resistive element electrically coupled between the first and second supply terminals, the second MOS transistor and the first resistive element being directly electrically coupled to each other by a first junction point that is electrically coupled to a base of the first bipolar transistor;

a third MOS transistor and a second bipolar transistor electrically coupled in series between the first and second supply terminals, the third MOS transistor forming a current mirror with the first MOS transistor;

a second resistive element electrically coupled between a base of the second bipolar transistor and the first junction point; and a fourth MOS transistor and a third resistive element electrically coupled between the first and second supply terminals, the fourth MOS transistor and the third resistive element being electrically coupled to each other at a second junction point that defines an output terminal configured to provide the reference voltage, the fourth MOS transistor forming a current mirror with the second MOS transistor, a gate of the fourth MOS transistor and a gate of the second MOS transistor being electrically coupled to each other at a third junction point, the third MOS transistor being electrically coupled between the first supply terminal and the third junction point.

2. The device of claim 1, comprising:

a fifth MOS transistor electrically coupled between the first supply terminal and the output terminal, and a fourth resistive element series-connected with the second bipolar transistor, the fifth MOS transistor forming a current mirror with the first MOS transistor.

3. The device of claim 1, wherein a surface area of a collector of the second bipolar transistor is greater than a surface area of a collector of the first bipolar transistor.

4. A circuit for generating a reference voltage, comprising:

first and second supply terminals configured to provide a power supply voltage;

a first transistor and a second transistor electrically coupled in series between the first and second supply terminals;

a third transistor electrically coupled between the first and second supply terminals, the third transistor being directly electrically coupled to the second transistor;

a fourth transistor and a fifth transistor electrically coupled in series between the first and second supply terminals, the fourth transistor forming a current mirror with the first transistor, the second and fifth transistors having respective control terminals electrically coupled to each other at a first junction point and the third transistor is electrically coupled between the first supply terminal and the first junction point; and a sixth transistor and a first resistive element electrically coupled between the first and second supply terminals, the sixth transistor and the first resistive element being electrically coupled to each other at a second junction point that defines an output terminal configured to provide the reference voltage, the sixth transistor forming a current mirror with the third transistor, a control terminal of the sixth transistor and a control terminal of the third transistor being electrically coupled to each other by a third junction point, the fourth transistor being electrically coupled between the first supply terminal and the third junction point.

5. The device of claim 4, comprising:

a second resistive element electrically coupled to the first transistor by the first junction point.

6. The device of claim 4, comprising:

a second resistive element electrically coupled between the control terminal of the fifth transistor and the first junction point.

7. The device of claim 4, wherein the second and fifth transistors are bipolar transistors.

8. The device of claim 7, wherein a surface area of a collector of the fifth transistor is greater than a surface area of a collector of the second transistor.

9. The device of claim 4, comprising:

a seventh transistor electrically coupled between the first supply terminal and the output terminal, the seventh transistor forming a current mirror with the first transistor.

10. The device of claim 4, comprising:

a second resistive element electrically coupled in series with the fifth transistor.

11. The device of claim 4, wherein the first, third, fourth, and sixth transistors are MOS transistors.

12. A circuit for generating a reference voltage, comprising:

first and second supply terminals configured to provide a power supply voltage;

a first transistor and a second transistor electrically coupled in series between the first and second supply terminals;

a third transistor electrically coupled between the first and second supply terminals, the third transistor being directly electrically coupled to the second transistor;

a fourth transistor and a fifth transistor electrically coupled in series between the first and second supply terminals, the fourth transistor forming a current mirror with the first transistor, the second and fifth transistors having respective control terminals electrically coupled to each other at a first junction point and the third transistor is electrically coupled between the first supply terminal and the first junction point;

a sixth transistor and a first resistive element electrically coupled between the first and second supply terminals, the sixth transistor and the first resistive element being electrically coupled to each other at a second junction point that defines an output terminal configured to provide the reference voltage, the sixth transistor forming a current mirror with the third transistor, a control terminal of the sixth transistor and a control terminal of the third transistor being electrically coupled to each other at a third junction point, the fourth transistor being electrically coupled between the first supply terminal and the third junction point;

a second resistive element electrically coupled to the first transistor by the first junction point; and a third resistive element electrically coupled between the first and second supply terminals, the second transistor and the third resistive element being electrically coupled to each other by the first junction point.

13. The device of claim 12, wherein the second resistive element is electrically coupled between the control terminal of the fifth transistor and the first junction point.

14. The device of claim 12, wherein the second and fifth transistors are bipolar transistors.

15. The device of claim 14, wherein a surface area of a collector of the fifth transistor is greater than a surface area of a collector of the second transistor.

16. The device of claim 12, comprising:

a seventh transistor electrically coupled between the first supply terminal and the output terminal, the seventh transistor forming a current mirror with the first transistor.

17. The device of claim 12, comprising:

a fourth resistive element electrically coupled in series with the fifth transistor.

18. The device of claim 12, wherein the first, third, fourth, and sixth transistors are MOS transistors.

* * * * *